US005816453A

United States Patent [19]

Spencer et al.

[11] Patent Number: 5,816,453

[45] Date of Patent: Oct. 6, 1998

[54] DISPENSER PUMP

[75] Inventors: Jeffrey William Spencer, Kirby Muxloe; Anthony Wass, Stanford, both of United Kingdom

[73] Assignee: The English Glass Company Limited, Leicester, United Kingdom

[21] Appl. No.: 702,460

[22] PCT Filed: Mar. 24, 1995

[86] PCT No.: PCT/GB95/00664

§ 371 Date: Sep. 23, 1996

§ 102(e) Date: Sep. 23, 1996

[87] PCT Pub. No.: WO95/25600

PCT Pub. Date: Sep. 28, 1995

[30] Foreign Application Priority Data

Mar. 24, 1994 [GB] United Kingdom ..... 9405891

[51] Int. Cl.[6] ..... B65D 88/54

[52] U.S. Cl. ..... 222/321.3; 222/321.7; 222/494; 222/383.3

[58] Field of Search ..... 222/321.7, 321.3, 222/321.1, 375, 494, 383.3, 380

[56] References Cited

U.S. PATENT DOCUMENTS

| | | | |
|---|---|---|---|
| 1,936,526 | 11/1933 | Seidel . | |
| 3,840,157 | 10/1974 | Hellenkamp . | |
| 4,054,152 | 10/1977 | Ito . | |
| 4,109,832 | 8/1978 | Kutik et al. . | |
| 4,230,242 | 10/1980 | Meshberg . | |
| 4,991,745 | 2/1991 | Brown | 222/212 |
| 4,991,747 | 2/1991 | Van Brocklin . | |
| 5,016,780 | 5/1991 | Moretti | 222/153 |
| 5,071,017 | 12/1991 | Stull | 222/494 |
| 5,222,637 | 6/1993 | Giuffredi . | |
| 5,234,135 | 8/1993 | LaFosse et al. . | |
| 5,284,132 | 2/1994 | Geier . | |
| 5,441,180 | 8/1995 | Woodruff | 222/327 |
| 5,549,223 | 8/1996 | Hori | 222/321.3 |
| 5,551,603 | 9/1996 | Woodruff | 222/325 |

FOREIGN PATENT DOCUMENTS

| | | | |
|---|---|---|---|
| 484616 B1 | 8/1994 | European Pat. Off. . | |
| 484615 B1 | 12/1994 | European Pat. Off. . | |
| 2177375 | 10/1973 | France . | |
| 2588835 | 4/1987 | France | 222/494 |
| 1115901 | 6/1968 | United Kingdom . | |
| 1117566 | 6/1968 | United Kingdom . | |
| 2111132 | 6/1983 | United Kingdom . | |

*Primary Examiner*—Andres Kashnikow
*Assistant Examiner*—Keats Quinalty
*Attorney, Agent, or Firm*—Fay, Sharpe, Beall, Fagan, Minnich & McKee

[57] ABSTRACT

A dispenser pump has an arrangement for sucking material out of its discharge nozzle after a dispensing stroke, to avoid clogging. The material is sucked through a suck-back passage provided by minor non-complementarity between a resilient outlet valve disc and its valve seat. The ball of the inlet valve is arranged to travel vertically in a tubular portion of the inlet passage in which it is a blocking fit, between its valve seat and an open cut portion where fluid flows freely past it into the pump chamber. During recharging at the pump chamber the ball is held in the open cut position. Once recharging stops, the ball falls gradually down the tubular position, drawing liquid back through the pump chamber until the inlet valve reseats.

10 Claims, 9 Drawing Sheets

42'
41'

42
71
2'
147
46

147

75

47

42

42
47
43
44
43

46
45
47

48
41

A
30
32
A 99
85
89
88
22

85
87
86
22
30

31
F
83
81
84
31
82
F
32

30
22

99
D
87
E
82
83
B
C 89
87
86
99

DISPENSER PUMP

This specification relates to dispenser pumps for dispensing fluids, particularly but not exclusively hand-operated pumps, and particularly but not exclusively pumps suitable for dispensing thick, pasty, viscous or setting liquids.

A dispenser pump of the general type to which our proposals relate has a pump, body defining a pump cheer (preferably cylindrical), a pump piston reciprocable in, the chamber, preferably manually, to alter its volume in a pumping stroke, an inlet for fluid to enter the pump chamber through a unidirectional valve (such as a ball or flap) from a container of product, and an outlet for fluid to leave the pump chamber, preferably also through a unidirectional valve such as a ball or flap, to a discharge opening. Desirable features include the following.

(a) A return spring urging the piston and chamber to a retracted condition, to recharge the pump chamber after each pumping stroke.

(b) An outlet assembly having the outlet, outlets valve and discharge opening as part of a head of the piston, e.g. to reciprocate with it.

(c) A vent passage in the pump, for air to enter the product container to compensate for dispensed product.

(d) A closure element incorporating the inlet and removably securable, e.g. by a snap-on or threaded cape to a container of material to be dispensed, and preferably fixed on the body but possibly fixed to the piston.

(e) Means for locking the piston in either a withdrawn ("locked-up") or inserted ("locked-down") condition relative to the pump body, to prevent operation of the pump e.g. for transport or display, and preferably including means for preventing fluid from leaking through the pump in the locked condition.

An embodiment of a preferred general form of pump (referred to below as "the preferred general form") is in our GB-A-2 111 132. This is a pup portable and operable in one hand. A closure cap element, for fitting onto a product container for product intake, is directed sideways on the pump body, i.e. transversely to the pump's axial direction. The rear end of the pump body has a rearwardly-directed grip surface to seat between the thumb and first finger of a user's hand. The piston has a cross-piece with forwardy-directed grip surfaces grippable by two fingers of that same hand, extending transversely on opposite sides of the piston axis for one handed operation.

Such a pump is a preferred context for new proposals made herein.

One aspect herein is concerned with avoiding clogging of an elongate discharge channel or nozzle by dried product. This is a special problem with thick fluids, such as some fabric conditioners and medicaments. The drying of product in the nozzle can make dispensing difficult or impossible. It can cause liquid product to be dispensed with unpredictable speed or direction variations, and may reduce dose accuracy.

It is known to provide a suck-back arrangement to draw fluid out of the nozzle after dispensing.

U.S. Pat. No. 4,991,747 (Risdon) keeps the outlet valve open over a small initial portion of the recharge stroke, by an interaction between the outlet valve body and a body steam projecting up into the hollow piston, or by lost motion between the outlet valve body and its seat. The outlet valve body is a rigid, unsprung sliding component.

U.S. Pat. No. 5,234,135 (Valois SA) has a multi-part piston/nozzle assembly, the space downstream of the outlet valve having a relatively enlarged part and a narrow nozzle.

At the end of the recharge stroke the return spring takes up lost motion between piston/nozzle assembly components, expanding the enlarged part to suck material back from the narrow nozzle. The outlet valve operates by axial movement between rigid components of the complex assembly.

Our aim is to provide new and useful dispenser pumps, with suck-back arrangements. Preferred aims include increased effectiveness with thick or viscous liquids;

simple valve construction;

uniform closing and reliable priming.

In one aspect we propose that the pump's outlet assembly provides a suck-back passage open in the closed condition of the outlet valve. This can give a longer period over which suck-back can act, enabling improved results with thick/viscous liquids.

In another aspect, a suck-back passage may bypass the outlet valve or may be defined at least partially through it. In particular a movable outlet valve member, such as a resiliently deformable member, and preferably an elastomer layer, desirably controls it or defines it at least in part. (Note: "suck-back passage" comprehends plural suck-back passages unless the context requires otherwise.)

In another aspect a valve seat with which an outlet. valve member co-operates may provide a suck-back passages by a predetermined or controlled non-complementarity between them. For example one may have one or more local projections or recesses presented to the other.

In another aspect the outlet assembly may provide one or more outlet passages, subject to the outlet valve, which are fully closed in the closed condition while a suck-back passage remains open. The outlet passage(s) may have substantially greater flow area than the suck-back passage.

In another aspect the suck-back passage may close if the reverse pressure imbalance from a discharge channel exceeds some threshold value, e.g. during recharge.

Such options may be implemented by shaping the valve seat against which a single resiliently deformable outlet valve member acts, enabling economy of parts by comparison with prior art proposals.

For example, a discharge-only outlet passage may emerge through a part of the valve seat fully complementary with the valve member, to close as soon as there is pressure balance or s light reverse imbalance. Conversely a suck-back passage may open through a part of the valve seat where the valve member cannot (completely) cover its opening, or where an appreciable back pressure is required to overcome a non-complementarity (e.g. a cantilevering of the valve member over the seat in the rest condition) and close off the suck-back passage.

In another aspect a resilient layer trapped at its edges, with one or more central openings, is proposed as an outlet valve member.

A preferred feature is a local cross-sectionally enlarged region of the discharge channel/nozzle immediately downstream of the outlet valve, leading into a relatively restricted channel. This forms an accumulator chamber which by its larger volume per unit length increases the tolerance of effective clearance to variations in the volume sucked back.

Another preferred feature is that the outlet valve has valve seat and valve member openings which are offset from one another in the open condition. This helps to reduce nozzle jet velocity without using a very wide nozzle which would give indefinite direction of the dispensed fluid. A divergence of the discharge channel also helps.

The measures described above can give useful results using the pressure imbalance inevitably arising in the recharge stroke with thick or viscous liquids, however, the following proposals bring further advantages.

Considering that the recharge stroke is typically fast, suck-back occurring during it must also be fast. This "primary" suckback may therefore shear liquid from the centre of the discharge channel and admit air through the resulting hole, rather than clearing the channel fully. Noting this, in independent aspects we provide measures for achieving a "secondary" suck-back by creating a reverse pressure imbalance after the recharge stroke.

In another aspect, therefore, we provide a closure delay arrangement to delay closure of the inlet valve after the recharge stroke, so that some reverse flow can continue to-drive or accommodate further suck-back from the nozzle. So, the inlet valve member may travel from its seat along a guide or track section of the inlet passage, desirably at least twice as far as its own width. The inlet valve member may be a ball or other solid plug member.

In a different aspect, a plunger arrangement communicates into the pump chamber and has a plunger which is a blocking fit in the surrounding passage thereof, but downstream of that enters an open section where fluid can flow around it. With such a construction, the movement of the plunger away from the pump chamber creates a pumping effect causing further suck-back at the outlet assembly.

These two aspects are very conveniently combined into an inlet valve construction, having the inlet passage formed with a valve seat, a restricted tubular section in which its valve member travels with a blocking fit, and an open section where fluid can easily flow around the valve member. The restricted section may be e.g. at least one-and-a-half times the axial length of the valve member. Using a simple ball or plug as the valve member, "secondary" suck-back may be implemented without any more components than for a normal inlet valve.

The inlet passage may be generally upright. The valve member may be a dense member e.g. a ball bearing, which effectively falls down the passage after recharging.

Another independent aspect relates to alignment and locking of the pump piston relative to the pump body. A rear end wall of the pump chamber had a fixed central plug projection and one or more peripheral openings for entry of fluid. The pump piston has a rearwardly-opening internal axial bore leading to the outlet. At the front end of the pump chamber is a keying projection engaging slidably in a recess of the piston exterior. This recess includes an axial track portion, extending along the stroke of the piston and, at the front end of the piston, a circumferentially-extending track portion bounded by a forwardly-facing cam surface.

Desirably the entire pump is assembled by snap-fitting and/or screw-fitting components. The dose dispensed is preferably between 1 and 10 ml, e.g. between 2 and 5 ml.

Embodiments, are now described with reference to the accompanying drawings, in which.

Figure 1:
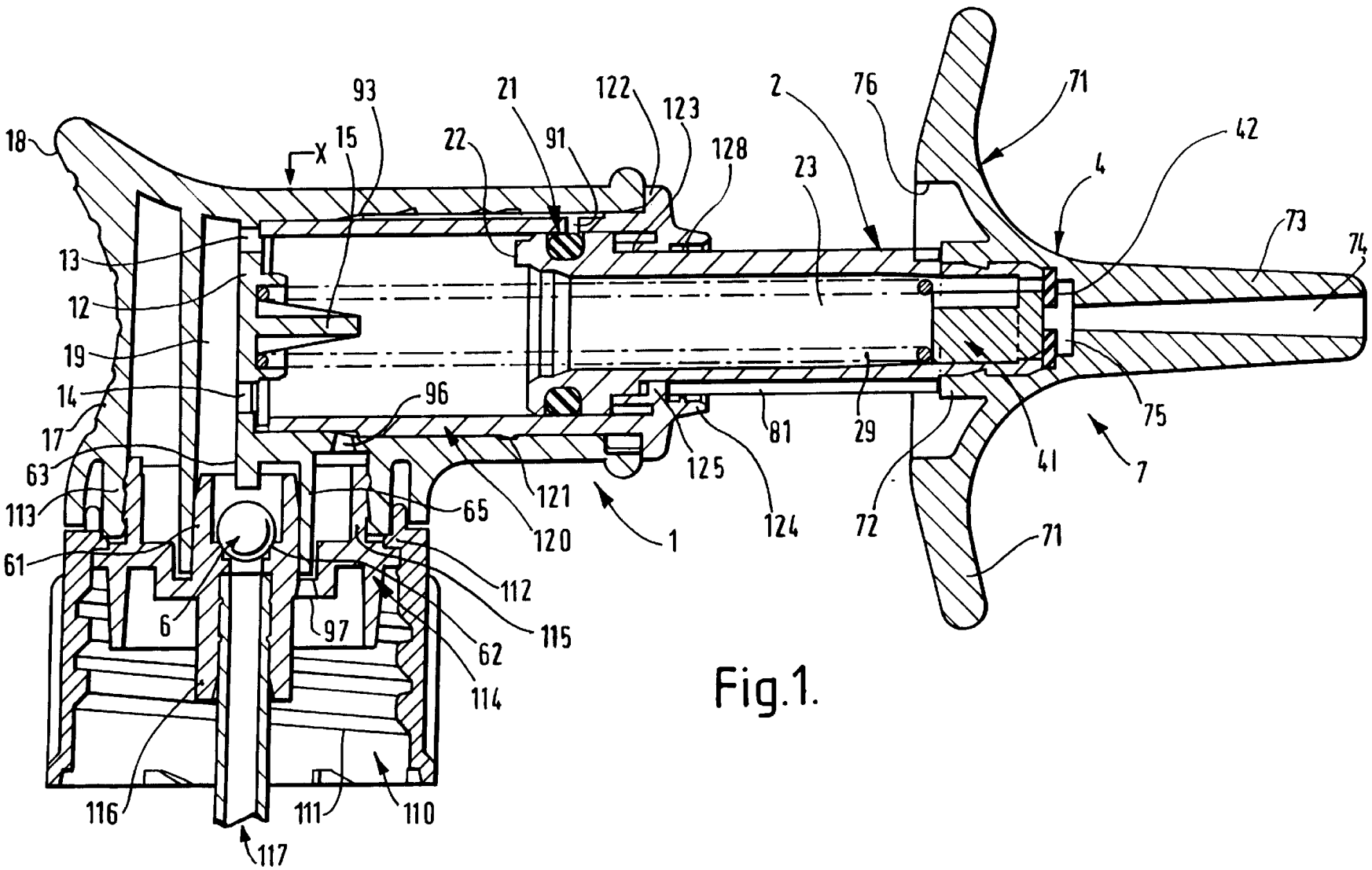
FIG. 1 is a vertical axial cross-section through a dispenser pump.
Figures 2A, 2B, 2C, 2D, 3A, 3B, 4A, 4B, 5, 5A:
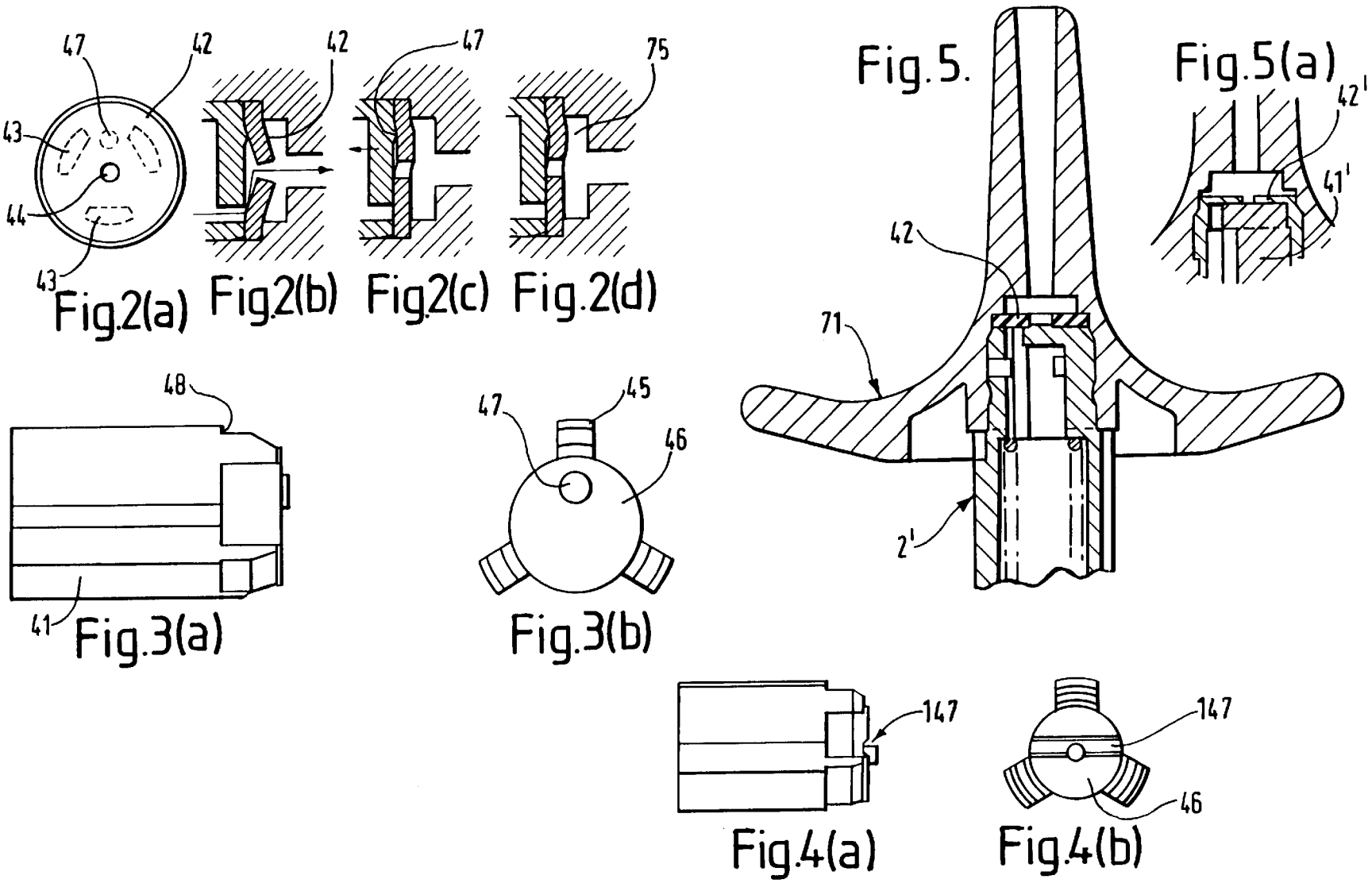
FIG. 2(*a*) shows a disposition of outlet valve apertures, and FIGS. 2(*b*) to (*d*) show a suck-back effect through the outlet valve.
Figures 6A, 6B, 6C, 6D, 6E, 6F, 6G, 6H:
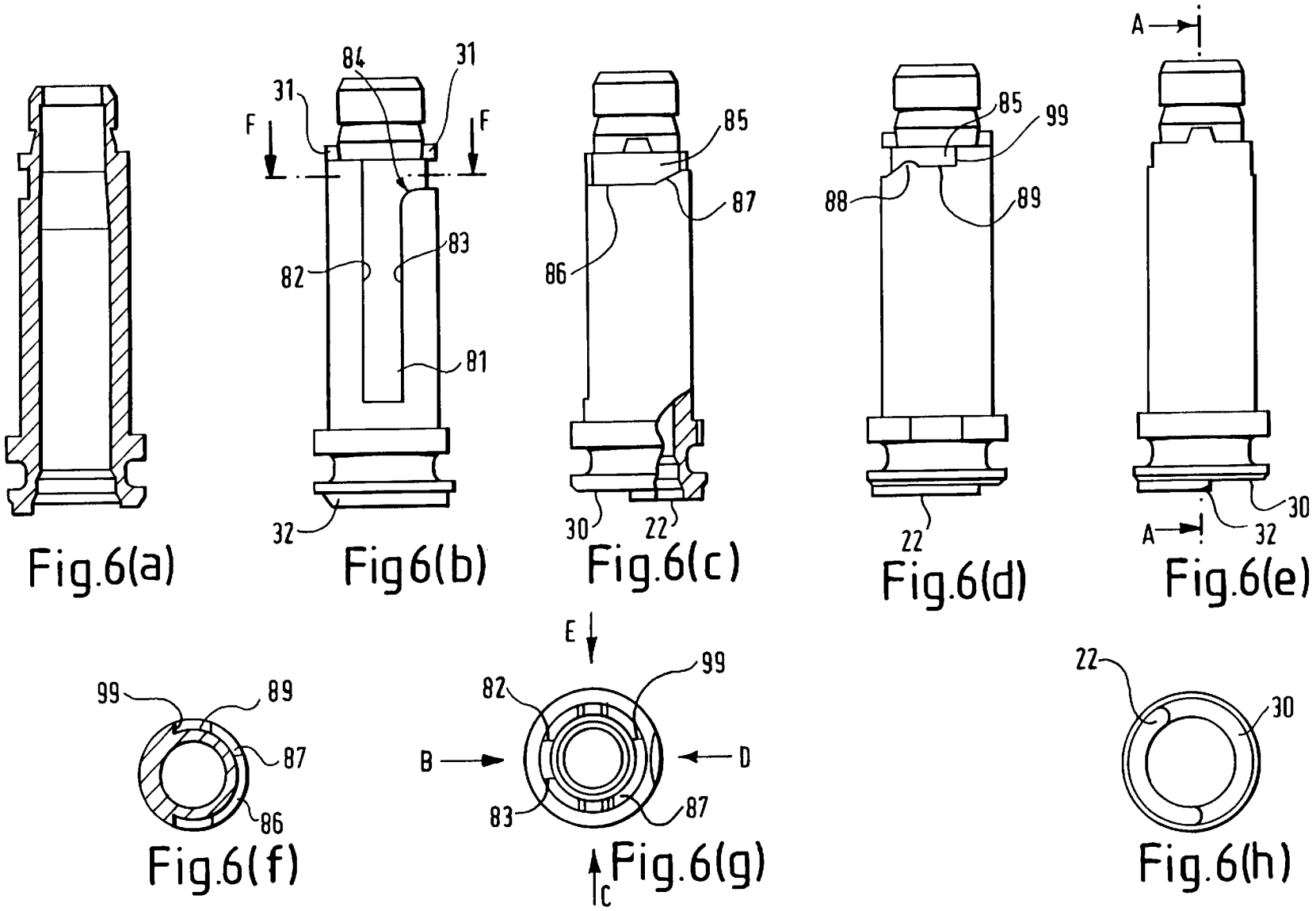
Figure 7:
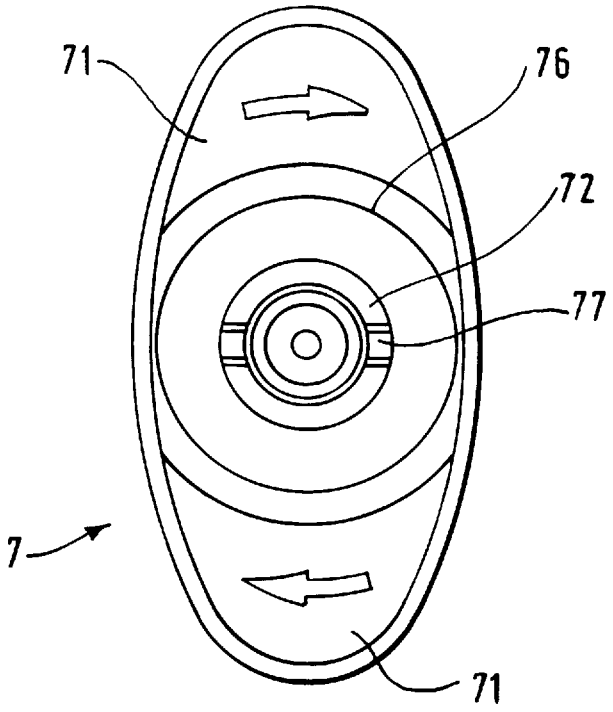
Figure 8:
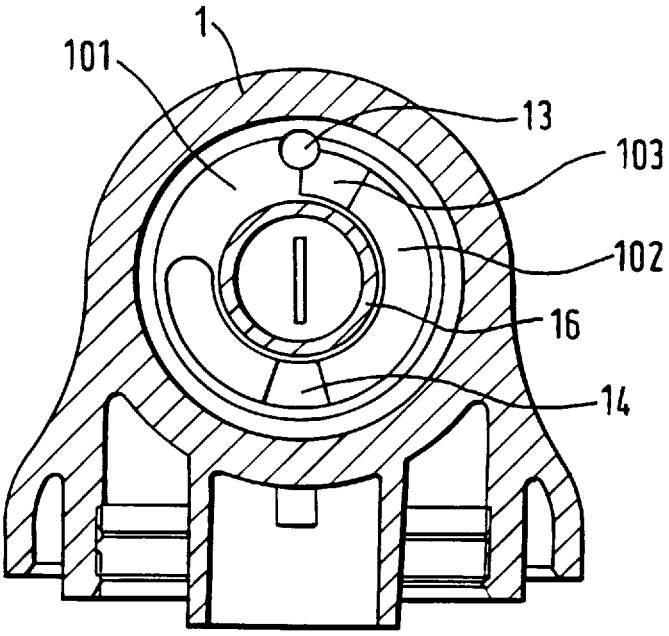
Figure 9A:
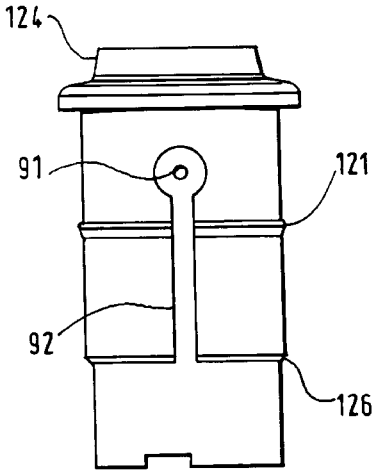
Figure 9B:
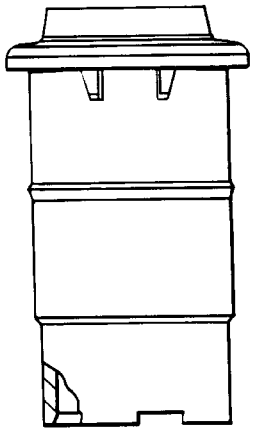
Figure 9C:
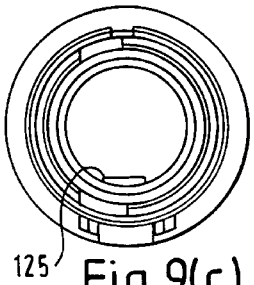
Figure 10A:
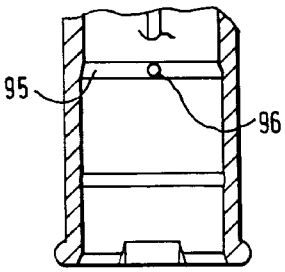
Figure 10B:
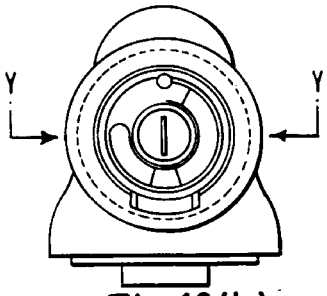
Figure 11C:
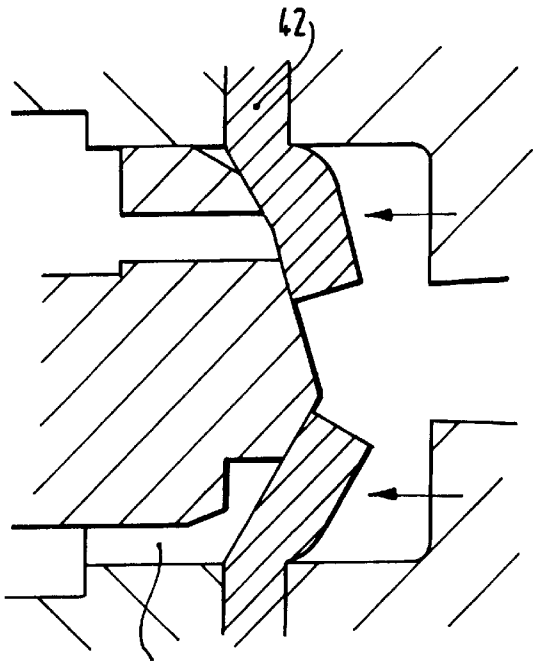
Figure 11B:
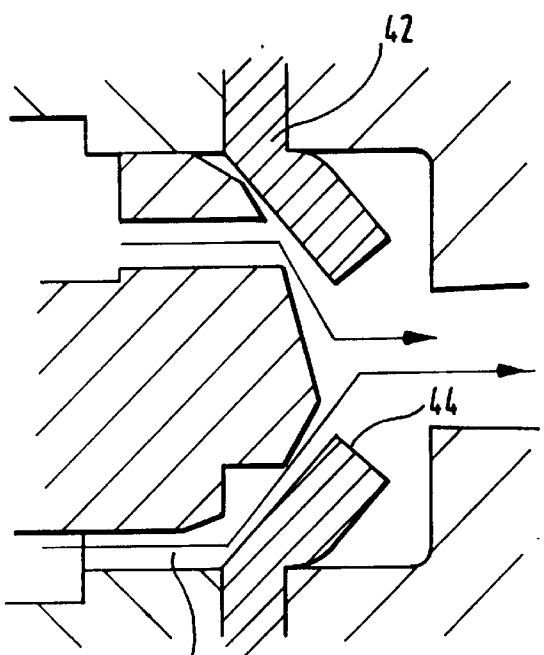
Figure 11A:
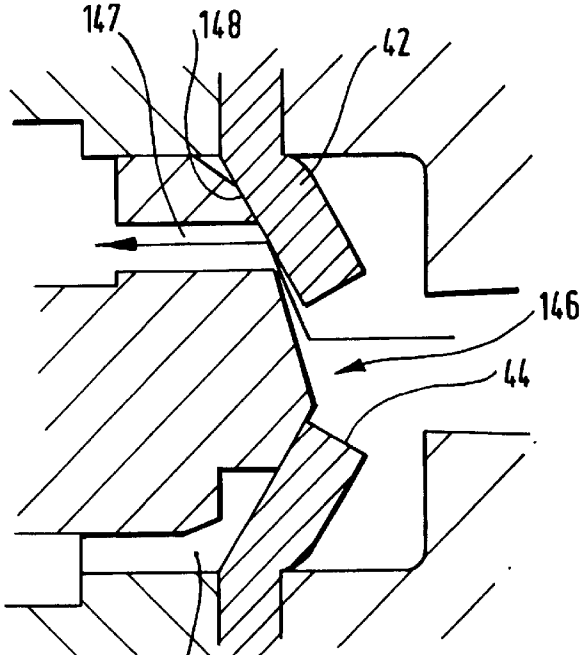
Figure 12C:
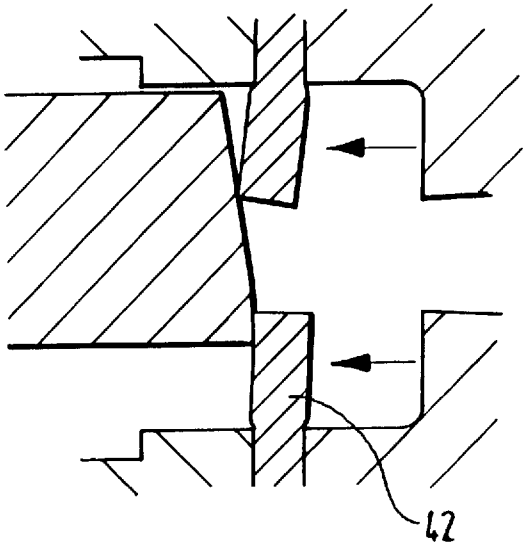
Figure 12B:
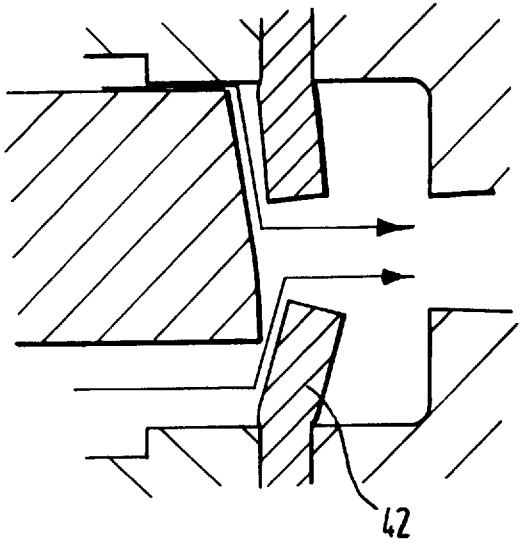
Figure 12A:
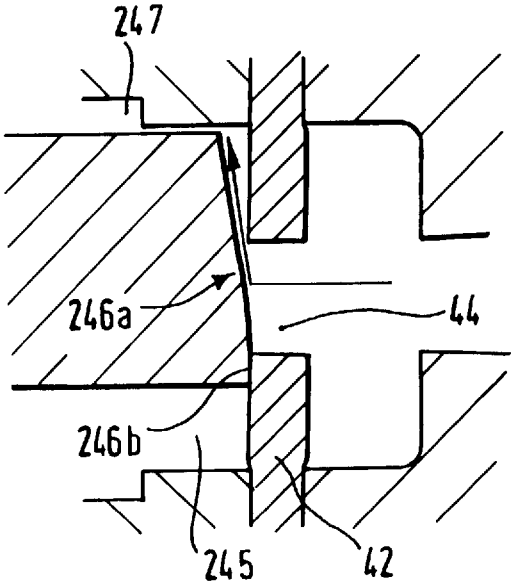
Figure 13C:
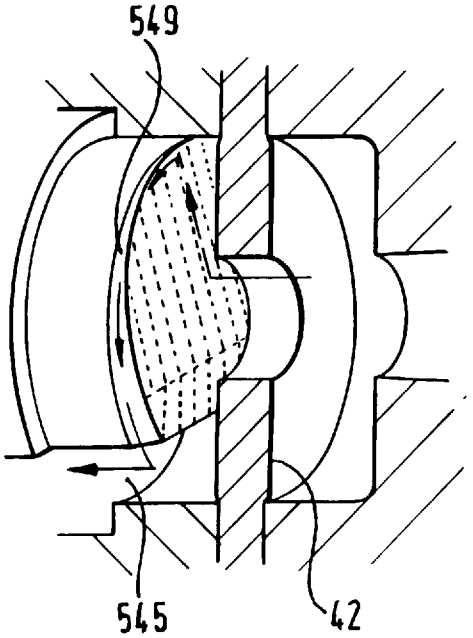
Figure 13B:
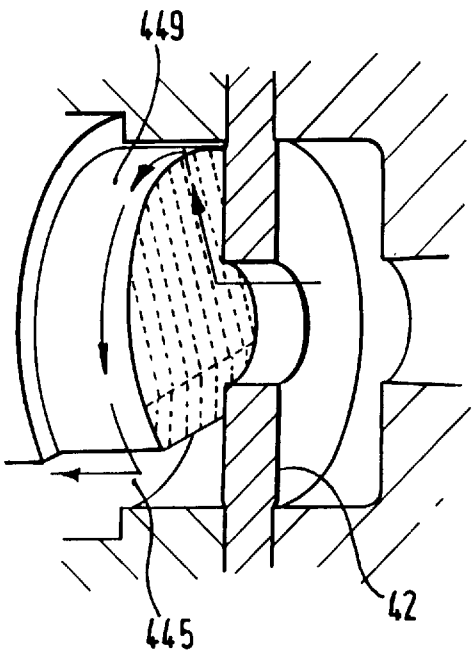
Figure 13A:
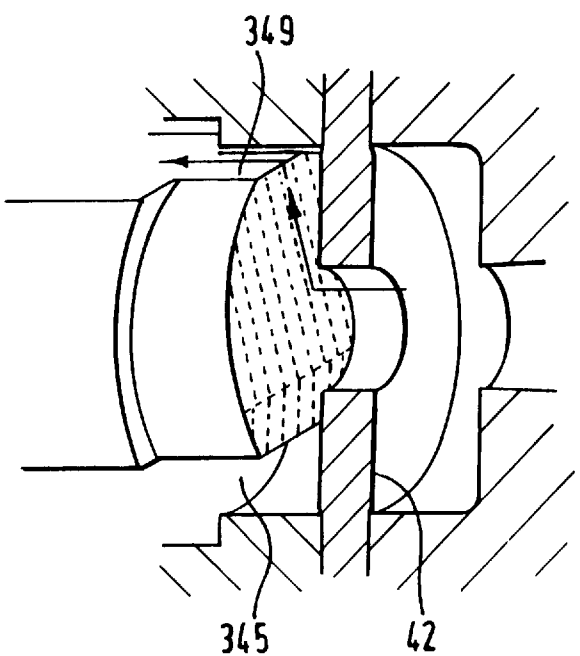
Figure 14:
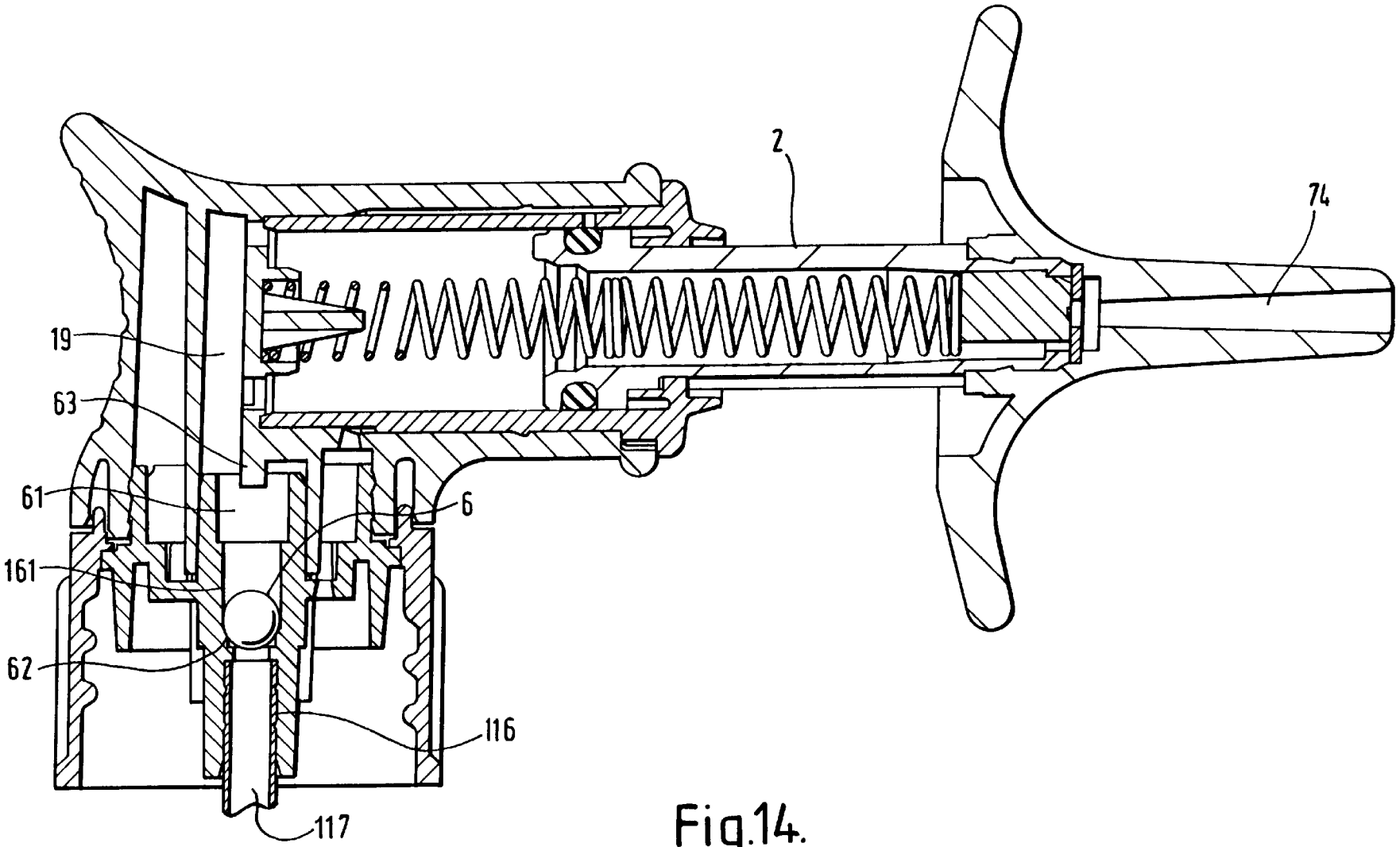

FIGS. 3(*a*) and (*b*) are respectively side and end views of a piston insert for forming an outlet valve seat;

FIGS. 4(*a*) and (*b*) are corresponding views of a different form of piston insert;

FIG. 5 is an axial cross-section showing a further outlet valve seat construction, and FIG. 5(*a*) a still further possibility;

FIG. 6 shows a piston component of the pump, FIG. 6(*a*) being a cross-section at A—A of FIG. 6(*e*), FIGS. 6(*b*) to (*e*) being side elevations along the respective directions B, C, D and E of FIG. 6(*g*), FIG. 6(*f*) being a radial cross-section at F—F of FIG. 6(*b*), FIG. 6(*g*) being a top view of the component and FIG. 6(*h*) a bottom view;

FIG. 7 is a rear view of a trigger and nozzle unit of the dispenser;

FIG. 8 is a radial cross-section of a pump body component taken at X in FIG. 1;

FIGS. 9(*a*), (*b*) and (*c*) are respectively top, bottom and front views of a liner sleeve of the pump body;

FIG. 10(*a*) and (*b*) show features of the outer pump body component, 10(*a*) being a section at Y—Y of 10(*b*) and showing interior features of the front of a barrel part of the body, and 10(*b*) being a view from the front;

FIGS. 11 (*a*), (*b*) and (*c*) are schematic axial sections showing operation of another outlet valve assembly;

FIGS. 12 (*a*), (*b*) and (*c*) are corresponding sections showing operation of another outlet valve assembly;

FIGS. 13(*a*), (*b*) and (*c*) are outlet valve sections showing three further ways of providing discrete suck-back and discharge-only passages;

FIG. 14 is a vertical axial section showing a special inlet valve construction providing secondary suck-back.

Refer first to FIG. 1. The dispenser pump has a main body 1 with a cylindrical barrel opening forwardly to receive a liner sleeve 120 retained in the barrel by a snap rib 121, and forming the inner surface of a pump chamber. A rear end wall 12 closes off the pump chamber. Upper and lower openings 13,14 communicate through the wall 12 for intake of product. The separate upper opening 13 avoids trapping air in the pump chamber. The wall's central portion has an annular forward projection 16 with an exterior sealing periphery, defining a central recess locating the and of a spring 29. A tapering central member 15 projects forwardly through the spring's interior.

A hollow pump piston 2 is reciprocable axially in the pump body. Around its rear, open end it has an outwardly-directed O-ring seal 21 wiping the inward surface of the liner sleeve. An internal bore 23 extends the full length of the shaft, closed off at its front end by a valve seat insert 41 against which the front end of the pump spring 29 acts. The rear face of the shaft has a circumferentially-localised projecting lug 22—see also FIG. 6.

The liner, mouth has a collar 123 which traps the sealing part of the piston. An axially-localised lug 125 projects inwardly from the collar 123, engaging in a track 81 of the piston shaft.

The inlet arrangement has a cylindrical cap 110 with a screw thread 111 for fitting on a container neck. At inward flange 112 at the top of the cap traps downwardly a discrete central closure element 114 having a central socket 116 to receive a flexible dip tube 117, and leading through the element 114 to an inlet ball valve 6. The ball seats on a part-conical valve surface 62 of an open valve cup 61, integral with the closure element 114, aligned beneath the rear wall 12 of the pump chamber, and push-fitted up into a depending circular skirt 65 integral with the pump body 1. The body 1 also has an outer depending skirt 113 making a snap engagement with an upstanding skirt 115 of the closure element 114. The pump body 1 is accordingly secured in a fluid-tight but rotatable manner on the screw-threaded closure cap 110.

A downward stop peg 63 on the pump body projects down into the top of the valve seat cup 61, spaced a short distance above the seated ball. No valve spring is used, but the stop 63 prevents the ball from escaping from the cup 61 when the pump is tilted. It is very easy to assemble.

Above the inlet valve 6, the intake passage is defined through an open space 19 behind the rear end wall 12.

A nozzle/trigger unit 7 is snap-fitted on the front end of the piston shaft 2. It has an elongated axial nozzle 73, in-line with the pump axis and having a discharge channel 74 with a divergent taper. First and second trigger-grip projections 71 (see also FIG. 7) extend transversely, and have forwardly-directed arcuate grip surfaces. An enlarged chamber 75 is provided at the inner end of the discharge channel 74, and traps with its annular rim the edge of a flexible valve member 42 against the front end periphery of the piston 2. Here, the valve element 42 is a nitrile rubber disc with a central through-hole 44. Shore hardness 60 is suitable. It rests against a transverse valve seat surface of the insert 41, described below.

The rearward surface 17 of the pump body 1 is concave in the vertical plane, rising into a projecting claw 18. One-handed contraction drives the piston 2 into the pump chamber, forcing the contents past the outlet valve and along the discharge channel 74. Release retracts the piston 2 under the force of the spring 29, recharging the pump chamber by opening the inlet valve 6.

Compensating air enters the liner sleeve 120 along the recessed track 81 (past the key projection 125) in front of the seal 21, through a vent hole 91 in the top of the sleeve 120 near its front end, along a narrow axial vent passage defined between the sleeve 120 and outer barrel 1 by a recessed axial vent path 92 of the liner sleeve's outer surface (see FIG. 9(*a*)), and rearwardly to an annular passage 93 defined between a rearward shoulder 126 of the liner sleeve 120 and a forward shoulder 95 of the body barrel inner surface (see FIG. 10(*a*)). At the bottom of the annular passage 93 a small opening 96 opens through the body into a space above the closure element 114, and a further small opening 97 through the closure element 114, beside the dip tube socket 116, communicates with the container interior.

Operation of the outlet valve is now described with particular reference to FIGS. 1, 2 and 3. The valve seat insert 41 has a circular front boas with a flat front face 46. Fins 45 (three shown) fit the inside surface of the piston shaft 2 and have forward shoulders 48 engaging a corresponding rearward shoulder in the piston shaft to locate the seat surface 46 axially precisely relative to the shaft. This is important for controlling/adjusting the suck-back effect to be described shortly. The seat surface may alternatively be in one piece with the piston shaft 2', as shown in FIG. 5. FIG. 5(*a*) shows another possibility where an insert 41' is used but the valve layer or disc 42' is integral with the piston shaft periphery.

The seat surface 46 is flat except for a small rounded nib 47, positioned off-centre. When the insert 41 is installed, three aperture segments 43 are defined between the body of the insert 41 and the front edge of the piston shaft. FIG. 2(*a*) shows these. The seat holes 43 and the disc hole 44 are substantially laterally staggered from one another, so that, liquid must travel sideways between them. This reduces the maximum exit velocity of the pump from perhaps ten to less than two metres. This reduction is furthered by a divergent taper of the discharge channel 74.

FIG. 2 illustrates a suck-back effect. On the inward stroke of the pump, pressure in the pump chamber is high and the outlet valve opens wide (FIG. 2(*b*)). Product is dispensed through all three seat openings 43 and through the central disc hole 44. At the end of the stroke, the pressures balance out and the disc relaxes to the closed position. The non-complementary nib 47 prevents complete closure. The spring 29 then expands to recharge the pump chamber, creating a strong reverse pressure imbalance and closing the outlet valve substantially fully as seen in FIG. 2.(*d*).

Particularly at the beginning and, at the end of recharging there is only a modest pressure difference across the outlet, which sucks fluid back through the valve from the discharge channel 74, in the condition of FIG. 2(*c*).

The volume sucked back is sometimes variable. The enlarged cross-section accumulator chamber 75 immediately downstream of the valve disc has a volume per unit axial length much greater than that of the discharge channel 74 itself. Accordingly even a variable degree of suck-back can reliably clear the narrow channel 74, the variation being taken up by varying degrees of emptying of the chamber 75.

A nib 47 is just one way of enabling some reverse flow. Others are possible, for example a recessing of all or part of the valve seat face relative to the rest conformation (at zero pressure difference) of the valve element. See FIG. 4. Here a groove 147 is formed in the seat surface 46. This is formed with a high profile (to reduce the viscosity effects) and does not close fully during recharging, but priming is found to be satisfactory.

Returning to FIG. 1, vertical orientation of the grip projections 71 relative to the pump body during pumping is assured by engagement of the liner sleeve's key projection 125 in the axial track 81 of the piston shaft. See FIG. 6. The track 81 is part of a complex recess enabling locking down of the pump piston. One side 82 of it extends straight back and meets the rearward face of the boss 72 of the nozzle unit 7. The other side 83 stops short of that, creating a corner 84 leading to a circumferential track portion 85 around substantially half of the shaft of the piston 2. The circumferential portion 85 is bounded by a rear cam wall having an initial straight circumferential portion 86, an angled ramp portion 87 leading to a forwardmost extremity or ridge 88, and a final non-angled circumferential portion 89 (which could be slightly angled, however) leading to a stop surface 99.

The rear end of the piston 2 has a projecting lug 22, shown here extending around part of a circle, the remainder of the end periphery constituting a recessed segment 30.

Consider now the front face of the rear wall 12 of the pump chamber, with reference to FIGS. 1 and 8. FIG. 8 shows the body component alone. Around the annular plug 16 is an annular surface region having the upper and lower intake openings 13,14. One flat segment 101 (of the order of 90°) of this surface, adjacent the upper opening 13, defines a reference level. Relative to that a major segment 102 of the annular surface is rearwardly recessed, including the lower opening 14. The recessed surface 102 ends at the upper opening 13 where a sloping segment 103 makes, a transition to the reference segment 101.

The normal operation of the pump, and locking-down, can now be understood.

As mentioned above, the piston's extension is limited by engagement of its sealing portion behind the liner collar 123. The rear lug 22 is at the top of the pump, and kept there to the end of the dispensing stroke by the keying projection 125 in the track 81. The end of the stroke is where the lug 22 meats the reference segment 101 at the rear wall 12 of the pump chamber. This prevents the plug 16 from closing the piston bore 23, reducing the tendency for the piston to stick in this position.

To lock the piston down, the nozzle unit 7 is then turned 180°. The piston shaft is constrained to turn too, by lugs 31 engaging rotationally in notches 77 of the socket boss 72. The circumferential track portion 85 moves onto the keying projection 125. Its initial straight portion 86 brings the piston's rear lug 22 progressively over the recessed segment 102 of the pump chamber's rear wall 12. Continued rotation moves tile ramp surface 87 past the keying projection 125, driving the piston backward to seat the lug 22 onto the recessed surface segment 103; the plug 16 then blocks the rear of the piston bore. The rearward movement reaches a maximum at the cam ridge 88 and is then somewhat relieved until the limit surface 99 prevents further rotation. The ridge 88 helps to maintain the locked condition. Alternatively, a gently sloping ramp formation of portion 89 may take the rear displacement back to the maximum.

At the normal end-of-stroke position the socket boss 72 barely meets the front opening 124 of the liner sleeve 120. In the locked-down condition however the socket boss 72 is forced into that front opening over a sealing bead 128, closing off the vent passageway. Also, the outer rim 76 of an annular depression 78 around the socket boss 72 rides onto the front of the liner sleeve, further enclosing the pump mechanism.

The dose size of the illustrated pump is about 3 ml. The pump body parts may be made of any suitable material, such as polypropylene. The pump spring 29 and inlet ball valve 6 are preferably steel.

FIGS. 11 to 13 show further possibilities for the outlet, valve arrangement, showing the versatility achievable with a simple rubber valve disc by appropriate shaping of the valve seat.

FIGS. 11(*a*) to (*c*) show an embodiment in which the insert seat face 146 is convex, to pretension the valve disc 42 and give positive sealing;

one way past the seal is a discharge-only passage 145: the disc 42 overlies it flush to seal it off fully in both the rest and recharging modes (*a*) and (*c*);

an opposing passage 147 is a suck-back/discharge passage: under positive pressure it opens to contribute to discharge (11(*b*)); under strong reverse pressure it closes fully (11(*c*)) but under light-reverse pressure an angled ramp 148 on the face 146 holds the relevant disc segment cantilevered above the opening of the passage 147 to allow suck-back when a suitable reverse pressure prevails.

This design has the advantage that the degree and speed of suck-back can be adjusted purely by modifying the dimensions of the passage 147.

FIG. 12 shows a different seat insert face 246 which has a sideways chamfered portion 246*a* meeting the perpendicular face portion 246*b* at a line crossing the disc opening 44. The chamfer 246*a* leads back to a narrow suck-back passage 247 of desired shape (see FIG. 13 below); a larger discharge-only passage 245 is masked by the seal against the perpendicular face 246*b*. FIGS. 12(*a*); (*b*) and (*c*) show the conditions for (*a*) rest or mild back-pressure (suck-back); (*b*) strong positive, pressure (discharge through all passages); (*c*) strong reverse pressure (valve entirely shut).

FIGS. 13 (*a*), (*b*) and (*c*) show three ways of forming the suck-back passage from the chamfer 246*a*. FIG. 13 (*a*) shows a flat 349 opposing the cylindrical wall to form a narrow channel. FIG. 13(*b*) shows radial clearance 449 around the head of the insert, for leading the suck-back round the head and into the main discharge passage 445. FIG. 13(*c*) shows an edge bevel 549 providing access from around the chamfer to the main discharge channel 545. In each case suck-back will be blocked by strong reverse pressure pressing the disc 42 down onto the chamfer.

FIG. 14 shows an important embodiment providing for a secondary suck-back, after the recharging stroke has finished.

The difference is in the inlet valve, where the portion, 161 of the inlet passage in which the ball 6 sits on its sealing valve seat 62 is not an open cup 61 as in FIG. 1 but a closely-fitting tube 161, e.g. of vertical extent roughly twice the ball's diameter, opening at its top into the cup 61 as in FIG. 1. A stop peg 63 overlies the cup 61 as before to prevent escape of the ball 6, and the construction has the same number of parts and ease of assembly as the FIG. 1 construction.

There is an important difference in function, however. On the recharging stroke the outlet valve shuts and material is drawn up the dip tube 117 by the pressure differential. To pass the ball 6 it must lift the ball right up the cylindrical tube 161 and into the open cup 61 where liquid can flow around it. The ball stays there for as long as material is drawn past it i.e. until the end of the recharging stroke. At this time the pressure differential across the outlet valve drops, and its suck-back passage takes the corresponding condition. The ball 6 drops down into the fitting tube 161 and descends gradually to its sealing seat 62 over a period of perhaps several seconds for a viscous liquid. Since liquid can scarcely pass the ball 6 in the tube 161, a corresponding volume is effectively pumped slowly back down the dip tube 117 by the drop of the ball 6 and/or head of liquid. The corresponding gentle reverse pressure differential is highly suitable for causing a slow secondary suck back through the outlet valve, clearing the nozzle passage 74 even where viscous liquid is involved.

This secondary suck-back may be the only effective suck-back: primary suck-back (on the recharge stroke) is not essential. The use of secondary suck-back in combination with an outlet valve that closes fully over a threshold reverse pressure differential gives an excellent combination of thorough suck-back and accurate recharging.

We claim:

1. A dispenser pump for dispensing fluid material, comprising a pump body (1) defining a pump chamber;

a piston (2) acting in the pump body and reciprocable relative thereto between inserted and retracted conditions;

an inlet assembly comprising an inlet passage (116,19) to the pump chamber and an inlet valve (6) moveable between open and closed inlet conditions;

an outlet assembly comprising an outlet from the pump chamber, an outlet valve (4) downstream of the pump chamber, moveable between open and closed outlet conditions, and a discharge channel (74) downstream of the outlet valve (4);

arranged to operate in a pumping cycle comprising a dispensing stroke in which movement to the inserted condition forces fluid material out of the pump chamber through the outlet, in the closed-inlet and open-outlet conditions, and a subsequent discharge stroke in which movement to the retracted condition draws fluid material into the pump chamber through the inlet valve (6) in the open-inlet and closed-outlet conditions;

and comprising further a suck-back arrangement for drawing fluid material from the discharge channel after the dispensing stroke;

characterised in that the suck-back arrangement has a restricted suck-back passage communicating between the pump chamber and the discharge nozzle the closed-outlet condition, for fluid material to flow after the dispensing stroke from the discharge channel (74) back into the pump chamber in response to reverse pressure imbalance between the discharge channel and the pump chamber.

2. A dispenser pump according to claim 1 in which the outlet valve (4) has a movable outlet valve member (42) which at least partly defines the suck-back passage.

3. A dispenser pump according to claim 2 in which the outlet valve (4) has an outlet valve seat (41), the outlet valve member (42) has a sealing portion movable towards and away from engagement with the outlet valve seat and the valve member and seat have predetermined non-complementarity to provide the suck-back passage in the closed-outlet condition.

4. A dispenser pump according to claim 3 in which one of the valve member (42) and seat (41) has a localised protuberance or recess to create the non-complementarity.

5. A dispenser pump according to claim 2 in which the outlet valve member (42) is resiliently deformable.

6. A dispenser pump according to claim 3 in which the outlet valve member (42) is resiliently deformable and a portion of the outlet valve member overlies the non-complementarity to close the suck-back passage when a threshold reverse pressure imbalance is exceeded.

7. A dispenser pump according to claim 1 in which the outlet assembly provides, in addition to said suck-back passage, an outlet passage (145, 245, 345) subject to the outlet valve (4) and fully closed thereby in the closed-outlet condition.

8. A dispenser pump according to claim 1 in which the suck-back arrangement comprises a closure delay arrangement to delay closure of the inlet valve after the recharge stroke.

9. A dispenser pump according to claim 1 in which the inlet valve comprises an inlet valve member (6) movable in the inlet passage and an inlet valve seat (62) in the inlet passage against which the inlet valve member can seal to provide the closed-inlet condition;

the inlet passage has a restricted tubular part (151) and an open part (61) downstream thereof, and the inlet valve member is movable along the restricted tubular part (161), making a blocking fit therein from the closed-inlet condition to the open part (61) where fluid can flow around it to provide the open-inlet condition.

10. A dispenser pump according to claim 9 in which the inlet valve member is a ball.

* * * * *